United States Patent [19]

Gardner

[11] Patent Number: 4,724,551

[45] Date of Patent: Feb. 16, 1988

[54] TOILET SEAT LID LOCK

[76] Inventor: Robert J. Gardner, 118 La Placentia, San Clemente, Calif. 92672

[21] Appl. No.: 917,717

[22] Filed: Oct. 10, 1986

Related U.S. Application Data

[63] Continuation-in-part of Ser. No. 842,197, Mar. 21, 1986.

[51] Int. Cl.[4] ..... A47K 13/00

[52] U.S. Cl. ..... 4/253; 4/661; 4/240; 4/236; 16/343; 16/347; 16/349

[58] Field of Search ..... 4/253, 236, 661, 240; 16/343, 347, 349

[56] References Cited

U.S. PATENT DOCUMENTS 2,651,053 9/1953 Rowe et al. ..... 4/253
2,698,439 1/1955 Bruckner ..... 4/253
4,479,273 10/1984 Raden et al. ..... 4/253
4,507,813 4/1985 Lawson et al. ..... 4/253
4,561,130 12/1985 Bumgardner et al. ..... 4/253

*Primary Examiner*—Henry K. Artis
*Attorney, Agent, or Firm*—Morland C. Fischer

[57] ABSTRACT

A toilet seat lid lock to reliably and releasably secure a toilet lid in a closed position above a toilet seat to deny access to the toilet bowl. The lid lock comprises a hinge arm connected to the toilet lid, a locking base connected to the hinge arm, and a locking handle pivotally connected to the locking base. The locking handle is rotatable around the locking base between open and locked positions. In the locked position, the locking handle is aligned with the locking base so as to form a stop against the toilet bowl and thereby block the rotation of the lid off the toilet seat.

14 Claims, 4 Drawing Figures

TOILET SEAT LID LOCK

RELATED APPLICATIONS

This patent application is a continuation-in-part of patent application Ser. No. 842,197, filed Mar. 21, 1986.

BACKGROUND OF THE INVENTION

1. Field of the Invention

This invention relates to a low cost, easily operable locking device to prevent small children from raising a toilet seat lid and gaining access to the water filled toilet bowl.

2. Prior Art

A toilet bowl filled with water often attracts small, unattended children and, consequently, poses a potential safety hazard. A child as young two years in age is usually capable of raising a toilet lid, whereby to gain access to the toilet bowl. It is therefore desirable to restrict access to the toilet bowl so as to prevent the child from accidentlly falling or throwing foreign objects into the bowl whereby to avoid injury and possible plumbing repair costs.

In the past, Velcro hook and loop fasteners have been secured to opposing surfaces of the toilet seat and lid. A sufficient upward force must be exerted upon the lid to separate the fasteners from one another and raise the lid off the seat. However, such fasteners are sometimes inconveniently positioned on the toilet seat so as to make using the seat uncomfortable. Other conventional means for preventing access to the toilet bowl involves complicated catch or lock mechanisms which are typically expensive and/or hard to operate. Accordingly, no low cost, easily operable apparatus is known which is adapted to reliably and releasably secure a toilet lid in the closed position above a toilet seat to deny access to the toilet bowl therebelow.

SUMMARY OF THE INVENTION

Briefly, and in general terms, an easily operated lid lock is disclosed to reliably and releasably secure a toilet lid in a closed position above a toilet seat to deny access to the toilet bowl therebelow. The lid lock comprises a hinge arm, one end which is connected to the toilet lid to accommodate the rotation of the lid off the toilet seat. The other end of the hinge arm is connected to a locking base. The locking base has a narrow slot formed therein. The lid lock also comprises a locking handle having a flange extending outwardly from a side thereof. The flange is sized to be received within the slot of the locking base. A pivot pin extends through both the locking base and the flange of the locking handle such that the handle is rotatable around the base from a locked to an open position. In the opened position, the locking handle is located at a side of the locking base to permit the rotation of the lid off the toilet seat. In the closed position, the locking handle is located behind the locking base to form an elongated stop, such that an attempted rotation of the toilet lid causes the stop to be rotated downwardly and against the toilet bowl to block the rotation of the lid off the toilet seat.

DESCRIPTION OF THE PREFERRED EMBODIMENT

Figure 1:
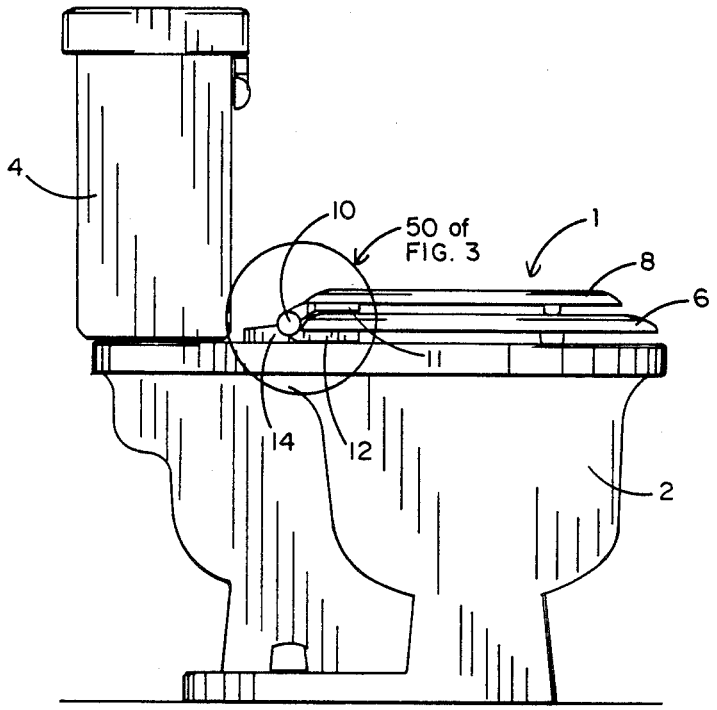
FIG. 1 is a perspective view showing the lid lock which forms the present invention installed on a conventional toilet.

The toilet seat lid lock which forms the present invention is best understood while referring to the drawings. In FIG. 1, there is shown a conventional toilet having a well-known, water filled toilet bowl 2, a flush tank 4, a toilet seat 6 and a lid 8 overlying the seat. The toilet seat 6 and lid 8 are pivotally connected together by horizontally extending shafts (not shown) which are received in pockets 10 of respective pairs of lid and seat hinge arms 11 and 12 (best shown in FIG. 3). As will be explained in greater detail hereinafter, the lid hinge arm 11 is particularly adapted to carry the lid lock 50 which is moveable into a locked or open position to control access to the toilet bowl 2. A pair of anchors 14 secure the hinge arms 11 and 12 to a rearward area along the rim of the toilet bowl, so that the seat 6 and lid 8 may be rotated around the shafts and raised upwardly from the toilet bowl in the normal fashion.

Figure 2:
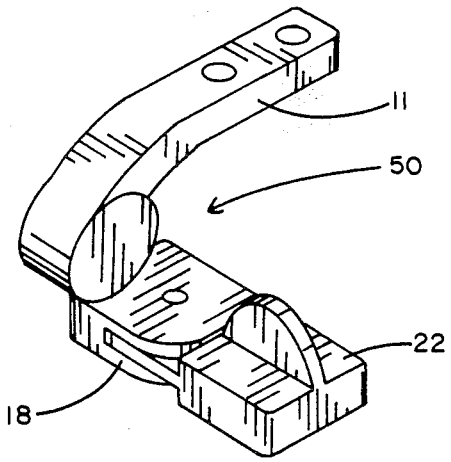
FIG. 2 is a perspective view of the lid lock.
Figure 3:
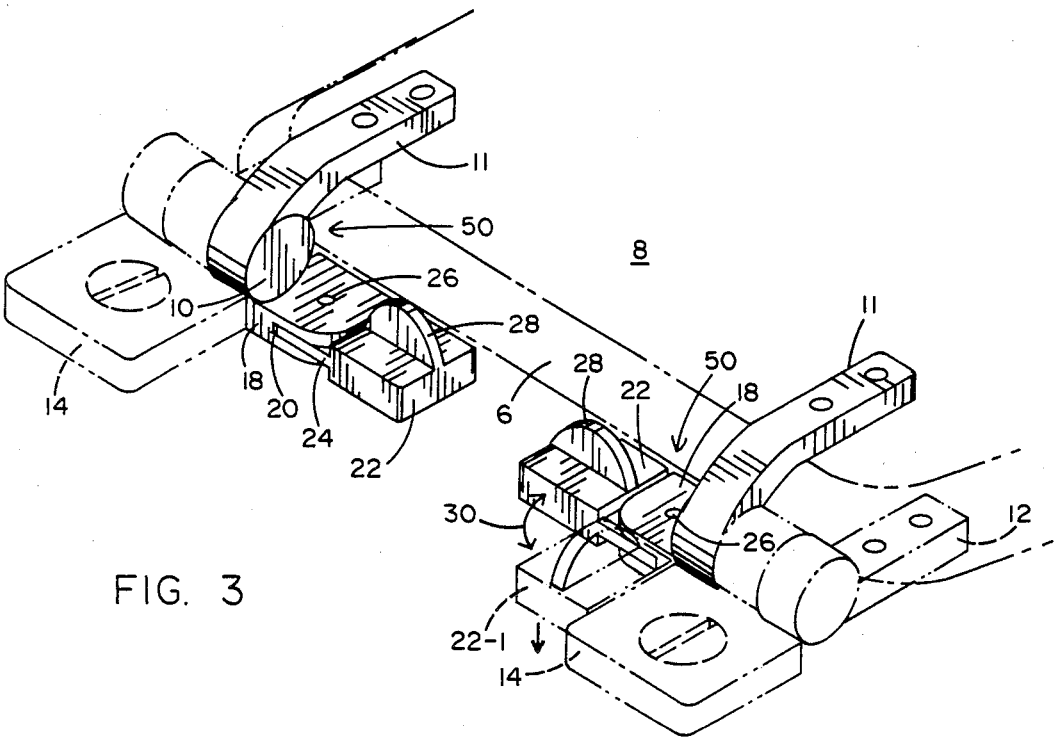
FIG. 3 shows the lid lock of FIG. 2 with the toilet seat and lid in a closed position across the top of a toilet bowl.

Details of the lid lock 50 are now described while referring concurrently to FIGS. 1–3 of the drawings. Although an identical pair of oppositely aligned lid locks 50 are preferably utilized (best illustrated in FIG. 3), only one of such lid locks is described below. Lid lock 50 comprises the aforementioned lid hinge arm 11 which replaces the conventional hinge arm that is commonly associated with commercially available toilet seats. Like the conventional hinge arm, one end of hinge arm 11 of lid lock 50 is affixed (e.g. by means of screws or the like) below the toilet seat lid 8 to accommodate rotation of the lid 8 off the seat 6. The opposite end of hinge arm 11 receives at pocket 10 the shaft around which the toilet seat 6 and lid 8 may rotate when raising or lowering the seat and lid relative to the toilet bowl.

Connected to the hinge arm 11 below the pocket 10 is a locking base 18. With the toilet seat 6 and lid 8 lowered, locking base 18 rests against the rim of the toilet bowl immediately beind toilet seat 6 (best shown in FIG. 3). A narrow slot 20 is formed through the locking base 18 for an important purpose which will now be described. Associated with the locking base 18 is a locking handle 22. Locking handle 22 has a flange 24 extending outwardly from one side thereof. The flange 24 is particularly sized to be received within the slot 20 of locking base 18. A pivot pin 26 extends through each of the locking base 18 and flange 24, whereby locking handle 22 is rotatable around pivot pin 26. A finger tab 28 projects upwardly from locking handle 22 to provide a contact surface and permit a user to easily rotate the locking handle 22 between open and locked positions (best illustrated in FIG. 3), so that access to the toilet bowl may be selectively controlled. In accordance with a preferred embodiment of the invention, the hinge arm 11, locking base 18 and locking handle 22, which form lid lock 50, are fabricated from plastic, although other suitable materials may also be used.

Figure 4:
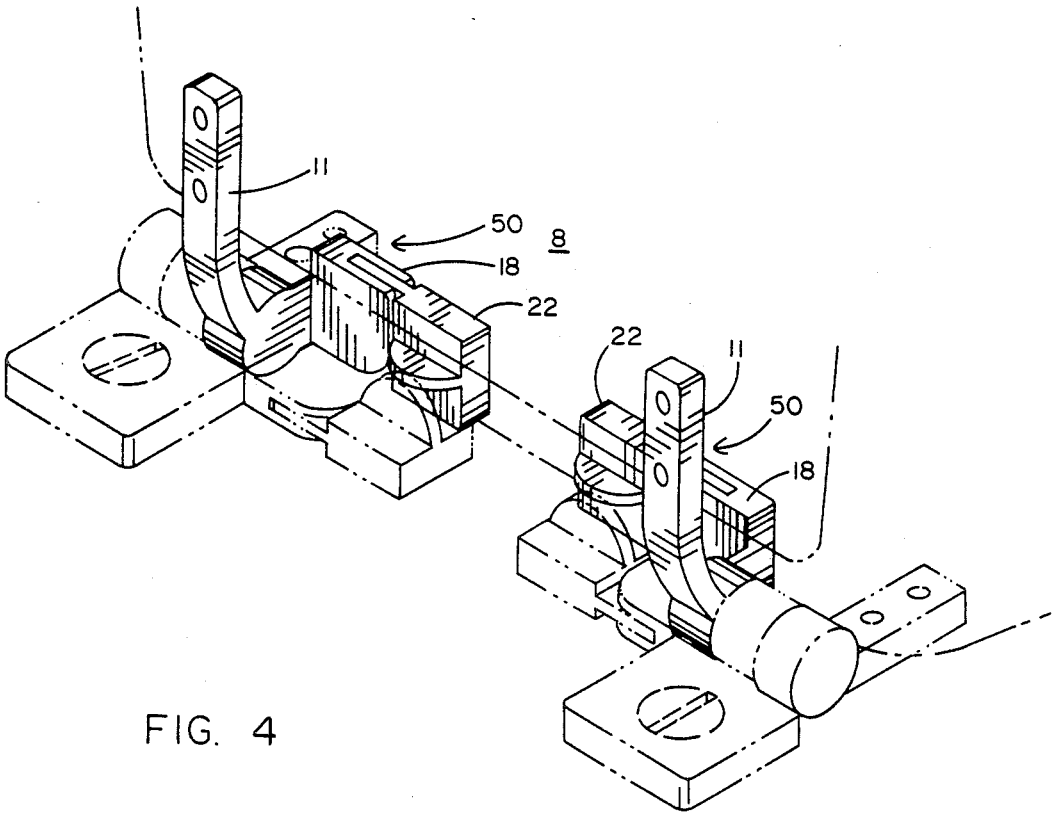
FIG. 4 shows the lid lock and the toilet lid raised upwardly and off the toilet seat.

The operation of lid lock 50 is now described while referring to FIG. 3 of the drawings. As previously indicated, locking handle 22 is rotatable around pivot pin 26 between open and locked positions. More particularly, the locking handle 22 is shown in FIG. 3 in the opened position along a side of locking base 18. In the open position, locking handle 22 is located out of the path of rotation of toilet lid 8. Hence, a user may easily raise the lid 8 to gain access to the toilet bowl. The orientation of the hinge arm 11, locking base 18 and locking handle 22 of lid lock 50 in the open position is shown in FIG. 4 with the toilet lid 8 raised to an upright position. That is, the lid lock 50 will rotate with the toilet lid 8 whenever the lid is raised to an upright position. The position of the lid lock 50 in the open position is shown in phantom in FIG. 4 prior to lifting the toilet lid off the seat.

Referring once again to FIG. 3, the user moves the lid lock 50 to the locked position (shown in phantom and designated by reference numeral 22-1) by grasping finger tab 28 and rotating locking handle 22 in the direction indicated by reference arrow 30. In the locked position, locking handle 22 is located behind locking base 18 and across the path of rotation of the toilet lid 8. More particularly, with the locking handle 22 located behind the locking base 18, an elongated stop is established, such that an attempted rotation of the toilet lid 8 causes the stop to be rotated downwardly and against the rim of the toilet bowl to block the rotation of the lid 8 off the toilet seat 6. Therefore, the lid 8 cannot be raised (e.g. by a small unattended child), to expose the toilet bowl until the locking handle 22 is rotated out of the locked position and into the opened position, as earlier described.

By virtue of the present invention, the user may safely and selectively deny access to a toilet bowl by the low cost and easy to operate lid lock 50. Accordingly, an uncomplicated and reliable means is available for connection at a toilet to prevent a small child, or the like, from accidentally falling or throwing objects into the toilet bowl. However, access to the toilet bowl is easily obtained by merely rotating locking handle 22 at finger tab 28.

It will be apparent that while a preferred embodiment of the invention has been shown and described, various modifications and changes may be made without departing from the true spirit and scope of the invention.

Having thus set forth a preferred embodiment of the present invention, what is claimed is:

1. A toilet seat lid lock to releasably secure a toilet lid in a closed position above a toilet seat to prevent access to the toilet bowl, said lid lock comprising:

a locking base;

a hinge arm extending between the toilet lid and said locking base to support a rotation of said lid off the toilet seat; and a locking handle pivotally connected to said locking base, said locking handle being rotatable around said locking base between open and locked positions, said locking handle forming a stop when moved to the locked position, such that an attempted rotation of the toilet lid causes said stop to be rotated against the toilet bowl to block the rotation of the lid off the toilet seat.

2. The lid lock recited in claim 1, wherein said locking base has a slot formed therein, a portion of said locking handle being received within said slot, and means to pivotally connect said locking handle portion to said locking base within said slot so that said locking handle is rotatable around said locking base.

3. The lid lock recited in claim 1, wherein said locking handle includes a finger tab extending outwardly therefrom, said finger tab providing a contact surface for rotating said locking handle around said locking base.

4. The lid lock recited in claim 1, wherein said locking handle is moved to said open position at a side of said locking base to permit the rotation of said lid off said seat or said locking handle is moved to said locked position behind said locking base to form said stop and block the rotation of said lid off said seat.

5. A toilet seat lid lock to releasably secure a toilet lid in a closed position above a toilet seat to prevent access to the toilet bowl, said lid lock comprising:

a locking base;

a hinge arm extending between the toilet lid and said locking base to support a rotation of said lid off the toilet seat; and locking means interconnected with and movable to open or locked positions relative to said locking base, said locking means being moved to said open position at a side of said locking base to permit the rotation of said lid off said seat or said locking means being moved to said locked position behind said locking base to form a stop, such that an attempted rotation of the toilet lid causes said stop to be rotated against the toilet bowl to block the rotation of the lid off the seat.

6. The lid lock recited in claim 5, wherein said locking means is pivotally connected to said locking base and rotatable therearound between the locked and open positions.

7. The lid lock recited in claim 6, wherein said locking base has a slot formed therein in which to receive a portion of said locking means, and means to pivotally connect said locking means portion to said locking base within said slot so that said locking means is rotatable around said locking base.

8. The lid lock recited in claim 6, wherein said locking means includes a finger tab extending outwardly therefrom, said finger tab providing a contact surface for rotating said locking means around said locking base.

9. The lid lock recited in claim 6, wherein said locking base and locking means are aligned with one another in a common plane, said locking means being rotated around said locking base and through said common plane from the open to the closed position.

10. The toilet seat lid lock recited in claim 1, wherein said locking handle is rotated around said locking base between the open and locked positions through a plane which is different than the plane through which said toilet lid is rotated.

11. The toilet seat lid lock recited in claim 6, wherein said locking means is rotatable around said locking base between the locked and open positions through a plane which is different than the plane through which said toilet lid is rotated.

12. A toilet seat lid lock to releasably secure a toilet lid in a closed position above a toilet seat to prevent access to the toilet bowl, said lid lock comprising:

a base;

an arm extending between the toilet lid and said base to support a rotation of said lid off the toilet seat; and a locking member interconnected to said base and movable through a first plane around said base between open and locked positions, said locking member forming a stop when moved to the locked position, such that an attempted rotation of the toilet lid through a plane which is different from said first plane causes said stop to be rotated against the toilet bowl to block the rotation of the lid off the toilet seat.

13. The toilet seat lid lock recited in claim 12, wherein said locking member is pivotally connected to said base and rotatable therearound between the open and locked positions.

14. The toilet seat lid lock recited in claim 12, wherein said locking member is moved around said base to said open position at a side of said base to permit the rotation of the toilet lid off the toilet seat, or said locking member being moved around said base to said locked position behind said base to block the rotation of the lid off the seat.

* * * * *